United States Patent [19]

Merkel et al.

[11] 4,453,652

[45] Jun. 12, 1984

[54] CONTROLLED CURRENT SOLENOID DRIVER CIRCUIT

[75] Inventors: Stephen L. Merkel, Bay Village; Richard P. Price, Parma Heights, both of Ohio

[73] Assignee: Nordson Corporation, Amherst, Ohio

[21] Appl. No.: 301,731

[22] Filed: Sep. 16, 1981

[51] Int. Cl.[3] ..... B67D 3/00; H01H 9/00

[52] U.S. Cl. ..... 222/504; 361/154

[58] Field of Search ..... 222/504, 52, 511, 518; 361/154

[56] References Cited

U.S. PATENT DOCUMENTS

| | | | |
|---|---|---|---|
| 3,205,412 | 9/1965 | Winston | 317/148.5 |
| 3,235,775 | 2/1966 | Winston | 317/148.5 |
| 3,241,002 | 3/1966 | Smith | 317/148.5 |
| 3,293,505 | 12/1966 | Miller | 317/148.5 |
| 3,339,120 | 8/1967 | McGrath et al. | 317/148.5 |
| 3,628,102 | 12/1971 | Jauch et al. | 317/148.5 |
| 3,666,232 | 5/1972 | Melcher et al. | 251/129 |
| 3,725,678 | 4/1973 | Reddy | 307/264 |
| 3,786,314 | 1/1974 | Misch | 317/154 |
| 3,786,344 | 1/1974 | Davis et al. | 323/20 |
| 3,789,237 | 1/1974 | Doring | 307/104 |
| 3,827,604 | 8/1974 | Hamilton et al. | 222/146 HE |
| 3,889,162 | 6/1975 | Myers | 361/154 |
| 3,896,346 | 7/1975 | Ule | 317/154 |
| 3,946,285 | 3/1976 | Beery et al. | 317/123 |
| 3,982,505 | 9/1976 | Rivere | 123/32 EA |
| 4,148,090 | 4/1979 | Kawai et al. | 361/152 |
| 4,180,026 | 12/1979 | Schulzke et al. | 123/32 |
| 4,238,813 | 12/1980 | Carp et al. | 361/154 |
| 4,314,305 | 2/1982 | Williams et al. | 361/154 |

FOREIGN PATENT DOCUMENTS 2015841 9/1979 United Kingdom .

*Primary Examiner*—Joseph J. Rolla
*Assistant Examiner*—Michael S. Huppert
*Attorney, Agent, or Firm*—Wood, Herron & Evans

[57] ABSTRACT

A solenoid driver circuit for a solenoid-operated fluid dispenser in which a valve is operable to dispense a fluid under the control of the solenoid. The driver circuit receives externally applied turn-on and turn-off signals and energizes the solenoid in response to these signals. The driver circuit is responsive to a turn-on signal to couple a pull-in voltage across the solenoid to pull in a solenoid valve armature. The driver circuit is also operable to sense the level of current in the solenoid. When the solenoid current reaches a preset peak current level, the pull-in voltage is removed from the solenoid and replaced by a hold-in voltage. When the hold-in voltage is applied to the solenoid, the driver circuit is operable to control the level of the hold-in voltage in order to maintain a preselected hold-in current in the solenoid. The driver circuit controls the solenoid current so that it makes a gradual transition from the peak solenoid current level to a steady state hold-in current level. The voltage applied to the solenoid to establish the steady state hold-in current is removed by the driver circuit in response to an externally applied turn-off signal.

15 Claims, 3 Drawing Figures

CONTROLLED CURRENT SOLENOID DRIVER CIRCUIT

DESCRIPTION OF THE INVENTION

This invention relates generally to dispensing systems having solenoid-controlled valves for the dispensing of fluids and more particularly concerns a solenoid driver circuit for energizing a solenoid in such a system.

Solenoid-controlled valves for the dispensing of fluids find wide application in various types of fluid dispensing systems. Typically, in such systems, control signals are supplied from external sources such as timers or sensors at times at which the solenoid is to be energized or deenergized in order to control the fluid-dispensing valve. A driver circuit is provided which receives the control signals and energizes the solenoid in response thereto by coupling electrical power to the solenoid.

As will be discussed hereinafter in regard to an exemplary embodiment, the invention may be advantageously employed with a solenoid controlled hot melt adhesive applicator. In such a system, a solenoid is energized to open a valve in an adhesive gun to permit the dispensing of hot melt adhesive onto objects moving past the gun. The control signals for the system are developed by sensors coupled to timers so that each object is satisfactorily positioned relative to the gun to receive the desired application of adhesive.

In its simplest form in such a system, the solenoid is a coil of copper wire on a hollow coil form defining a tubular opening into which a valve armature, or plunger, is drawn from a biased position when the solenoid is energized. The solenoid coil itself may be approximately electrically represented as a resistor and an inductor connected in series, which may be viewed as the solenoid resistance and inductance, respectively. In a quiescent condition, with a d-c voltage applied to the solenoid, the current in the solenoid is determined by the applied voltage divided by the solenoid resistance.

The resistance of a copper solenoid coil winding increases with increasing temperature. When the coil is coupled to a source of electrical power, the temperature of the coil increases due to the heat created by the dissipation of power in the coil resistance. Since the current in the solenoid, on a steady state basis, is equal to the applied voltage divided by the solenoid resistance, the solenoid current is affected both by variations in the voltage applied to the solenoid and by changes in the solenoid resistance such as those caused by solenoid temperature changes.

In systems such as hot melt adhesive application systems, where the solenoid exerts a force on a movable armature in order to move the armature to open a valve, the force applied to the armature by the solenoid coil and magnetic structure is substantially proportional to the magnetic flux of the solenoid which is in turn substantially proportional to the solenoid current. Typically, an initial large pull-in force, created by a pull-in current, is required to overcome the force applied to a biased valve armature to move it away from the valve opening and into the solenoid. Once the armature has been drawn into the solenoid, opening the valve, a lower hold-in force, created by a hold-in current, is required to maintain the armature in the solenoid.

In the past, a preselected high voltage has been applied to the solenoid to open the valve, with the voltage maintained on the solenoid for a preselected period of time. After the expiration of the preselected time, the voltage applied to the solenoid is changed to a lower second voltage, which is maintained until the valve armature is to be released from the solenoid to close the valve.

It can be appreciated that if the resistance of the solenoid varies with temperature, the amount of solenoid current which results from the application of a preselected voltage will vary in dependence upon the solenoid temperature. Often the variations are considerable. In one such system, for example, with solenoid currents on the order of two amperes, increased temperature can produce resistance variations of about 80%.

Other factors may also contribute to the temperature fluctuations of the solenoid, further complicating any prediction of the current, and hence, of the solenoid valve armature force, for preselected voltage settings. Inductance variations occur among solenoids. This causes the transient current to vary among solenoids in response to the application of the same pull-in voltage for the same time interval. In the case of the application of hot melt adhesives, external heat is applied to the adhesive, which also influences the temperature of the solenoid. Further, the operation of the solenoid may be on an intermittent basis so that the power applied to the solenoid varies over different periods of time. Consequently, the heat generated by the solenoid resistance will vary. There can also be power supply drift or other power supply variations over time so that preselected settings for pull-in and hold-in voltages may actually result in voltages other than those selected being applied to the solenoid.

From the foregoing, it can be seen that the application to a solenoid of a fixed pull-in voltage and a fixed hold-in voltage, which voltages may themselves be subject to change, leads to considerable solenoid current variations. Since the solenoid resistance is variable, solenoid currents are produced which are in general either too large or too small to properly and efficiently control the solenoid valve armature. If the system is overdesigned to the point that the solenoid always pulls in the valve armature when the pull-in voltage is applied, then in most instances, too much pull-in current is applied to the solenoid. If the hold-in voltage is sufficient to provide adequate hold-in current in all conditions, then the hold-in current is too large in most cases.

If more power than is necessary to pull in and hold in the solenoid valve armature is applied to the solenoid, the excess power consumption results in extra operating expense. In addition, the excess power creates excess heat which must be dissipated through greater heat sinking or the like in order to avoid overheating the coil. On the other hand, if a lower pull-in voltage and hold-in voltage are applied to the solenoid, there may be cases in which the solenoid fails to pull in the valve armature or fails to hold it in. Such solenoid performance is, of course, not desirable.

It is consequently a general aim of the present invention to more precisely energize a solenoid in systems of the above-described type so that proper pull-in and hold-in forces are applied to a solenoid valve armature over a range of operating conditions.

In accordance with one aspect of the invention, an improved solenoid driver circuit applies a pull-in voltage to the solenoid, and the magnitude of the current flowing through the solenoid is sensed. When the sensed current reaches a level equal to a preselected peak current reference level, the pull-in voltage is removed from the solenoid.

In accordance with a further aspect of the invention, after the pull-in voltage is removed from the solenoid, a hold-in voltage is applied, and the sensed solenoid current is compared to a hold-in current reference level. The hold-in voltage is then controlled to maintain the sensed solenoid current at the hold-in current reference level.

In accordance with a still further aspect of the invention, when the pull-in voltage is removed from the solenoid and replaced by the hold-in voltage, the hold-in voltage is controlled to provide a gradual decline of the solenoid current from the peak pull-in value to a steady state hold-in value.

Several advantages flow from the above-mentioned control of the peak pull-in current, and of the hold-in current, through the solenoid. One basic advantage is that the solenoid power supply requirement is minimized. This is because only enough current flows through the solenoid coil to obtain the desired magnetic pull force on the armature, to pull in and hold in the armature. This reduces the amount of power which must be supplied to the solenoid and also reduces the amount of energy dissipated as heat which must be removed from the solenoid.

Another advantage is that the pull-in time for the valve armature is more nearly constant, since the same maximum allowable pull-in current is applied on each activation of the solenoid. A further advantage is that the release time of the solenoid, the amount of time for the valve armature to reseat to close the valve when the hold-in voltage is removed from the solenoid, is minimized. This occurs because consistently only enough current is applied during the hold-in period to hold the valve armature in the solenoid. The collapse of the solenoid magnetic field is enhanced by the provision of a snubber circuit which limits the peak reverse voltage induced across the solenoid coil and dissipates a substantial portion of the energy of the magnetic field. Thus, the strength of the magnetic field producing the force holding the valve armature will be no larger than necessary, and the consistently smaller magnetic field holding in the valve armature will more quickly collapse when the hold-in voltage is removed from the solenoid.

Also in accordance with an aspect of the present invention, the solenoid driver circuit is not affected by typical power supply voltage variations. To accomplish this, pull-in and hold-in current reference signals are used in the circuit which are independent of power supply variations.

Other objects and advantages of the invention will become apparent upon reading the following detailed description and upon reference to the drawings, in which.

Figure 1:
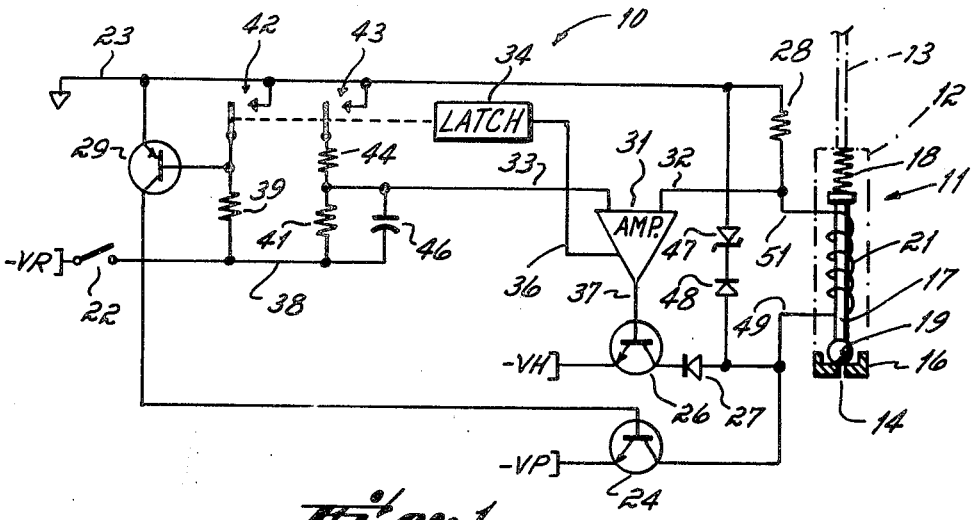
FIG. 1 is a simplified schematic diagram, partially in block diagram form, of a driver circuit constructed in accordance with the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

With reference initially to FIG. 1, a driver circuit 10 controls the coupling of electrical power to a valve assembly 11, which controls the application of a hot melt adhesive. The valve assembly 11 includes a valve body 12 receiving a supply of hot melt adhesive through a supply tube 13 and dispensing the adhesive through an opening 14 in a nozzle 16. The assembly 11 usually further includes a heater (not shown) for the hot melt adhesive in the body 12 as the adhesive passes therethrough. A valve armature 17 is biased at an end by a spring 18 so that the free end of the armature is urged toward the opening 14. A ball-shaped portion 19 at the free end of the movable armature 17 is received on a seat on the interior of the nozzle 16 at the opening 14 to form a valve for the dispensing of the hot melt adhesive.

In order to move the armature 17 against the force of the spring 18, away from the opening 14 to permit the flow of adhesive through the opening, a solenoid 21 surrounds the armature 17 with the armature free to move therein. When a voltage is applied to the solenoid 21, a magnetic force is exerted upon the armature 17 that moves it away from the opening 14 in opposition to the force of the spring 18, opening the valve.

The driver circuit 10 is operable to couple a pull in supply voltage VP to the solenoid 21 in response to an externally applied turn-on signal. In the circuit of FIG. 1, the application of an external turn-on signal is represented by the closing of a switch 22, and the application of a turn-off signal for the driver circuit is represented by opening the switch 22. A turn-on signal may be, for example, a delayed sensor signal indicating that an object to which hot melt adhesive is to be applied is properly positioned relative to the nozzle 16 and that the valve should be opened. Similarly, an externally applied turn-off signal may be representative of a timed sensor signal that the object has received the proper application of adhesive and that the valve is to be closed.

In the simplified schematic of FIG. 1, closing the switch 22 applies a reference supply voltage VR to the driver circuit 10, and opening the switch removes the reference voltage supply. The voltages VR and VP and a hold in supply voltage VH are negative with reference to a circuit common line 23, and are therefore each prefaced by a minus sign in the Figures.

In the driver circuit 10, the pull-in supply voltage VP is coupled to the solenoid 21 through a transistor switch 24. A controlled amount of the hold-in supply voltage VH is coupled to the solenoid 21 through a transistor 26 and a diode 27. The solenoid 21 is energizable in response to the turning on of the transistor 24 after an externally applied turn-on control signal and is also energizable in response to the activation of the transistor 26 after the transistor 24 is turned off, as shall be explained in more detail hereinafter. Whenever the solenoid 21 is energized, the current level in the solenoid is sensed by a current sensing resistor 28 which is connected in series with the solenoid. When the solenoid is energized, solenoid current flows through the current sensing resistor 28 and the solenoid 21.

In the present driver circuit, the transistor 24 operates as a switch to couple the pull-in supply voltage VP across the solenoid 21. Since the transistor 24 is controlled to be either on or off rather than operating in its active region, when the transistor is on, almost the entire pull-in supply voltage VP is connected across the solenoid. The voltage across the solenoid is less than the pull-in supply VP by an amount equal to the transistor 24 junction drop and a small voltage drop across the current sensing resistor 28. Consequently, the pull-in supply voltage VP connected to the emitter of the transistor 24 and the pull-in voltage applied across the solenoid shall both be referred to herein as the pull-in voltage VP.

The application of the pull-in voltage VP to the solenoid 21 by the transistor 24 is controlled by a transistor 29, which is coupled between the common line 23 and the base of the transistor 24. When the solenoid current reaches a preselected peak level, the transistors 29 and 24 are turned off to remove the pull-in voltage VP from the solenoid. After the removal of the pull-in voltage from the solenoid 21, the application of a portion of the hold-in supply voltage VH to the solenoid is controlled by the transistor 26, which is in turn controlled by an output of an amplifier and comparator circuit 31. The amplifier and comparator circuit 31 receives a sensed solenoid current signal, which is a voltage proportional to solenoid current, at a first input 32 and a changeable reference voltage signal at a second input 33.

The comparator and amplifier circuit 31 compares the two inputs 32 and 33. When the voltages appearing at the two inputs become equal, while the pull-in voltage VP is applied to the solenoid, the circuit 31 activates a latch circuit 34 through a first output 36. Subsequently, while a hold-in voltage is applied to the solenoid, the circuit 31 cooperates with the transistor 26 through a second output 37 to control the solenoid current so that the voltage proportional to solenoid current at the input 32 tracks the reference voltage at the input 33. Activating the latch circuit 34 not only removes the pull-in voltage VP from the solenoid 21 but also changes the reference voltage at the input 33 from a pull-in peak current reference value to a hold-in current reference valve.

The function of the driver circuit 10, as illustrated in FIG. 1, can best be explained by examining a cycle of operation. When it is desired to activate the solenoid 21, an externally applied turn-on control signal closes the switch 22, applying the reference supply voltage VR to a reference supply bus 38. The negative reference supply voltage VR is coupled through a resistor 39 to the base of the transistor 29, turning on the transistor. Turning on the transistor 29 turns on the transistor 24, and the pull-in voltage VP is applied across the solenoid 21.

The application of the reference supply voltage VR to the reference bus 38 also couples VR to the reference input 33 of the amplifier 31. As the pull-in current through the solenoid 21 increases, the sensed current signal at the input 32 to the amplifier 31 increases, the actual rate of the current increase in the solenoid being determined by the inductance of the solenoid and the magnitude of the voltage VP.

When the voltage at the input 32 equals the reference voltage at the input 33, the amplifier and comparator circuit 31 activates the latch 34 through the output line 36. The activation of the latch 34 closes two switches 42 and 43. The switch 42 is connected in series with the resistor 39 between the reference supply bus 38 and the common line 23. The switch 43 is connected in series with the resistor 41 and a resistor 44 between the reference supply bus 38 and the common line 23.

Closing the switch 42 removes the base voltage from the transistor 29, turning off the transistor. Turning off the transistor 29 turns off the transistor 24, removing the pull-in voltage VP from the solenoid 21.

Closing the switch 43 alters the reference voltage at the input 33 of the comparator and amplifier circuit 31. This occurs because the input 33 is connected between the resistors 41 and 44 which, upon the closing of the switch 43, now form a voltage divider between the common line 23 and the reference supply bus 38. Since a capacitor 46 is connected in parallel with the resistor 41, the reference voltage on the line 33 does not change instantaneously, but reaches a new value as the capacitor 46 charges through the resistor 44. The rate of change of the reference voltage is determined by the RC time constant of the resistor 44 and the capacitor 46.

During the application of the pull-in voltage VP to the solenoid 21, the transistor 26 has also been turned on by the output 37 from the amplifier 31 to couple the hold in supply voltage VH through the transistor to the cathode of the diode 27. During the pull-in period, however, the voltage VP at the anode of the diode 27 keeps the anode of the diode more negative than its cathode, so the diode 27 blocks the hold-in supply voltage VH. With the removal of the pull-in voltage VP, all of the solenoid current is supplied from the hold-in voltage VH through the transistor 26.

The amplifier and comparator circuit 31, the transistor 26 and the current sensing resistor 28 operate as a closed loop control of the solenoid current. The output 37 of the comparator 31 turns on the transistor 26 to a sufficient degree that a controlled amount of current flows in the solenoid. This amount of current is a current which results in the voltage at the input 32 developed across the current sensing resistor 28 being nearly equal to the reference voltage at the input 33. Immediately after the removal of the pull-in voltage VP from the solenoid, as the reference voltage falls to the hold-in value, amplifier 31 causes transistor 26 to become less conductive such that the voltage proportional to solenoid current tracks with the gradually falling reference voltage at the input 33. It will be recalled that the reference input signal gradually falls with the charging of the capacitor 46 until it reaches a voltage corresponding to a hold-in current reference level set by the resistor 41 and resistor 44 voltage divider. Since the transistor 26 operates in its active region to serve as a current control rather than as a switch, the voltage applied to the solenoid after the removal of the pull-in voltage VP is usually significantly less than the full hold-in supply voltage VH. Therefore, a distinction should be made between the hold-in supply voltage VH and the hold-in voltage, which is that voltage actually applied to the solenoid.

When the driver circuit 10 receives an externally applied turn-off control signal to deenergize the solenoid, the switch 22 opens and the reference signal is removed from the amplifier and comparator input 33. The amplifier and comparator circuit 31 quickly turns off the transistor 26 removing the hold-in voltage from being applied to the solenoid 21. The magnetic field in the solenoid collapses. The collapse of the magnetic field releases the armature 17 and it returns, under the force of the spring 18, to a valve-closed position with the ball 19 adjacent the opening 14 in the nozzle 16. At about the same time, the latch 34 resets, opening the switches 42 and 43. The driver circuit 10 is now conditioned to receive the next externally applied turn-on control signal.

In order to quickly dissipate the voltage induced across the solenoid at turn-off, and also to prevent damage to the transistors 24 and 26, a snubber circuit comprising a zener diode 47 in series with a diode 48 is coupled across the solenoid. The anode of the zener diode 47 is connected to the commcn line 23 and the cathode of the diode 48 is connected to the cathode of the zener diode 47. The anode of the diode 48 is connected to an end 49 of the solenoid 21. The other end 51 of the solenoid 21 is connected to the current sensing resistor 28 which is in turn connected to the common line 23. Therefore, the snubber circuit, made up of the zener diode 47 and the oppositely poled diode 48, is connected in parallel with the series connection of the current sensing resistor and the solenoid. When the voltage at the end 49 of the solenoid 21 is negative relative to the common line 23, the diode 48 is non-conductive and therefore, the snubber circuit has no effect on the circuit operation. However, when the magnetic field in the solenoid 21 collapses, producing a positive voltage at the end 49 of the solenoid, the diode 48 is forward biased and the zener diode 47 becomes conductive at its reverse breakdown voltage, clipping the peak of the induced voltage at the breakdown voltage level.

Figure 2:
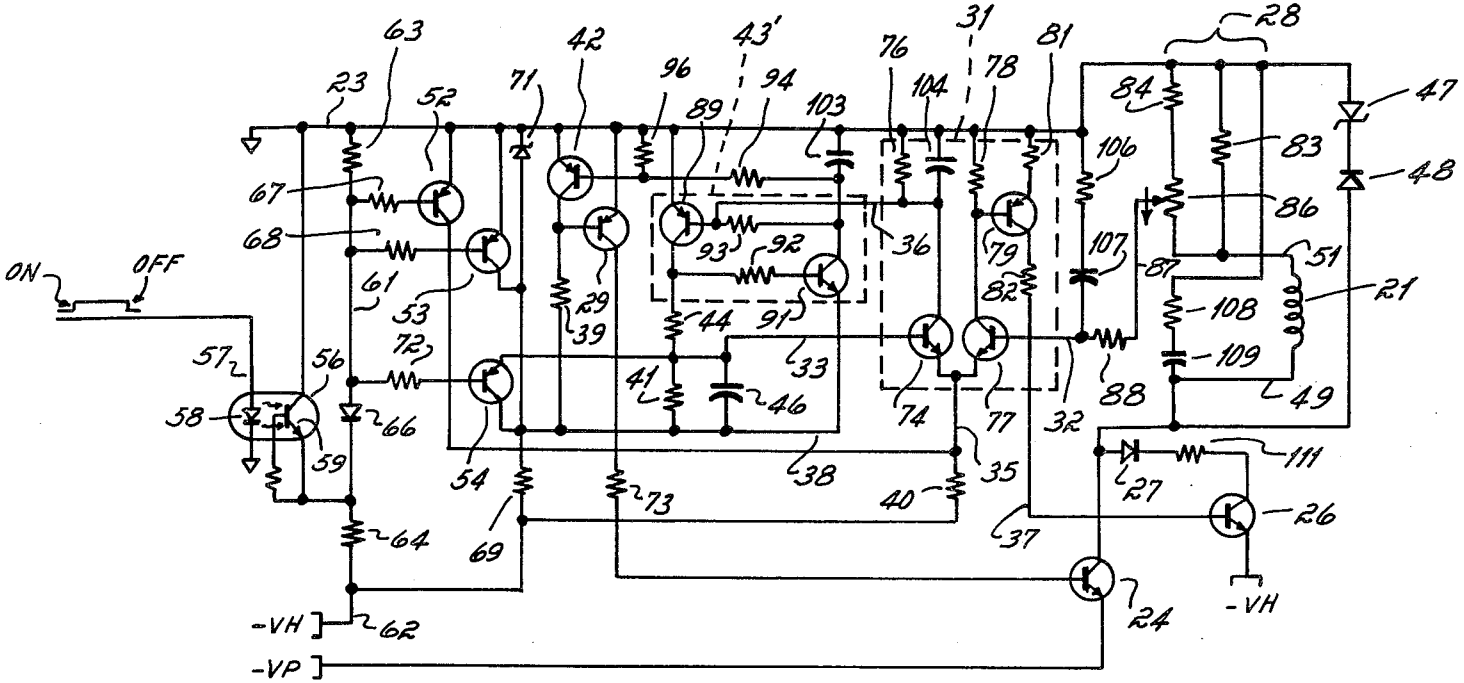
FIG. 2 is a more detailed schematic diagram of the circuit of FIG. 1.

With reference now to FIG. 2, the driver circuit 10 is shown in more detail. In FIG. 2, certain of the elements, such as the transistors 24, 26 and 29, are directly correspondent to elements of FIG. 1. The amplifier and comparator circuit 31 is shown in more detail in FIG. 2 and the elements of the circuit are enclosed by dashed lines. The latch 34 and the switch 43 of FIG. 1 are elements of a common circuit which is also enclosed in a dashed line and indicated as 43'. The functions of the switch 22 of FIG. 1 are performed by circuitry including transistors 52, 53 and 54, and an opto-isolator 56.

The driver circuit 10 is responsive to externally applied turn-on and turn-off control signals at an input 57, which is connected to a photodiode 58 in the opto-isolator 56. In this case, the turn-on control signal is the rising edge of a pulse, and the turn-off control signal is the falling edge of the pulse. A turn-on control signal, a rising edge of a pulse at 57, begins current flow through the photodiode 58, which illuminates the phototransistor 59 in the opto-isolator. Turning on the transistor 59 couples a switching bus 61, which had been at a negative voltage, to the potential of the common line 23. The removal of the negative voltage from the switching bus 61 removes the negative bias from the bases of the transistors 52, 53 and 54, turning off these transistors. Turning off each of these three transistors unclamps various voltages permitting the operation of the driver circuit 10.

The voltage applied to the switching bus 61 when the phototransistor 59 is turned off is substantially determined by a voltage divider between the common line 23 and a supply voltage input 62. The supply voltage 62 is a negative voltage conveniently of the same magnitude as the hold-in supply voltage VH. The voltage divider is made up of a resistor 63 connected in series with a resistor 64 between the common line 23 and the input 62.

A diode 66 is interposed between the two resistors, with the anode of the diode connected to the resistor 63 by the switching bus 61, to compensate for the small junction voltage drop in the phototransistor 59 when it is turned on. In this way, the switching bus 61 is at about the same potential as the common line 23, when the phototransistor is turned on. Having the switching bus at the potential of the common line 23 ensures that the transistors 52, 53 and 54 remain turned off when the phototransistor is on.

The transistor 52 is connected between the common line 23 and a supply bus 35 for the amplifier and comparator circuit 31. The bus 35 is coupled through a resistor 40 to the supply voltage 62. Before the phototransistor 59 is turned on, a negative voltage is coupled from the bus 61 to the base of the transistor 52 through a resistor 67 and the transistor holds the bus 35 to common, disabling the comparator and preventing any current flow therethrough.

The transistor 53 is connected between the common line 23 and the reference supply voltage bus 38. Before the phototransistor is turned on, the negative voltage on the switching bus 61 is coupled through a resistor 68 to the base of the transistor 53. The transistor 53 is therefore turned on, keeping the reference bus 38 clamped to the common line 23. When the voltage is removed from the switching bus 61, the transistor 53 turns off, and the voltage from the supply input 62 is coupled through a resistor 69 to the reference bus 38, which is connected to the common line 23 by a zener diode 71. The zener diode 71 has a breakdown voltage which establishes the reference supply voltage VR on the reference bus 38. The breakdown voltage of the zener diode 71 is selected at such a value that the supply voltage will always exceed the breakdown voltage over the range of expected supply voltage variations.

Before the phototransistor 59 turns on, the negative voltage on the switching bus 61 is also coupled through a resistor 72 to the base of the transistor 54. The transistor 54 therefore clamps the comparator reference input 33 to the reference voltage bus 38. In this way the capacitor 46 is shorted by the transistor 54 so the capacitor is fully discharged prior to each turn-on control signal. When the phototransistor turns on, the transistor 54 turns off, and the reference bus 38 is coupled to the reference input 33 through the resistor 41.

To summarize the switching on of the driver circuit 10, the reference voltage VR is applied to the reference voltage bus 38 by turning off the transistor 53 to unclamp the reference bus from the common line 23. In addition, the transistor 52 unclamps the supply bus 35 of the amplifier and comparator circuit 31, and the transistor 54 unclamps the reference input 33 of the comparator from the reference supply voltage bus 38.

When the reference supply voltage VR appears on the bus 38, the transistor 29 turns on. Since the collector of the transistor 29 is coupled to the base of the transistor 24 through a resistor 73, the transistor 24 turns on. Turning on the transistor 24 couples the pull-in voltage VP across the solenoid 21, energizing the solenoid. With the application of the pull-in voltage across the solenoid, current begins to flow in the solenoid, and a sensed current signal is applied at the solenoid sensed current input 32 of the amplifier and comparator circuit 31.

The amplifier and comparator circuit 31 includes a transistor 74 whose collector is coupled through a resistor 76 to the common line 23. The base of the transistor 74 is connected to the reference signal input 33 of the comparator. The comparator circuit further includes a transistor 77 whose collector is coupled to the common line 23 through a resistor 78. The base of the transistor 77 is connected to the sensed current input 32 of the comparator. The emitters of the transistors 74 and 77 are connected together at the supply voltage bus 35. The current from the supply 35 divides between the transistors 74 and 77, depending upon the degree to which each of the transistors is turned on. The voltage at the bus 35 tracks at one transistor junction voltage drop less than the voltage at the more positive of the two bases of the transistors 74 and 77.

The comparator and amplifier circuit 31 further includes a transistor 79 whose emitter is coupled through a resistor 81 to the common line 23 and whose collector is coupled through a resistor 82 to the base of the hold-in voltage transistor 26. The base of the transistor 79 is connected to the junction between the collector of the transistor 77 and the resistor 78.

When the supply voltage bus 35 is unclamped by the transistor 52 after the application of a turn-on control signal to the driver circuit 10, the transistor 77 turns on since it has a more positive base voltage than the transistor 74. At this time, the transistor 74 has the negative reference supply voltage VR applied to its base, and the transistor 77 initially has no voltage relative to common at its base. When the transistor 77 turns on, the transistor 79 turns on. Turning on the transistor 79 turns on the transistor 26, which is coupled to the hold-in supply voltage VH. Since at this time the pull-in voltage VP, which is of a greater magnitude than the hold-in supply voltage VH, is applied to the end 49 of the solenoid 21, the hold-in supply voltage VH is blocked from the solenoid by the blocking diode 27. Although the degree to which the transistor 26 is turned on is unimportant during pull-in, the transistors 77 and 79 are nevertheless responsive to the solenoid sensed current signal at the input 32 to control the base voltage of the transistor 26.

As the current rises in the solenoid due to the applied pull-in voltage VP, the sensed current signal input 32 to the comparator and amplifier circuit 31 increases in magnitude. The current sensing resistance 28 of the simplified schematic of FIG. 1 comprises a low value resistor 83, for example on the order of a few ohms, connected in parallel with the series combination of a resistor 84 and a potentiometer 86. The resistor 84 and the potentiometer 86 are substantially higher in resistance than the resistor 83 to enable fine adjustment of the output voltage on the wiper arm 87 of the potentiometer. The voltage at 87 is coupled through a resistor 88 to the sensed current input 32 in the form of a solenoid sensed current signal.

As the current rises in the solenoid and the magnitude of the sensed current signal at the input 32 increases, the sensed current signal approaches the magnitude of the reference input 33 at the base of the transistor 74. Therefore, the transistor 74 begins to turn on. As the transistor 74 begins to turn on, drawing current through the resistor 76, a transistor 89 in the latch circuit 43' turns on. When the transistor 89 turns on, the other transistor 91 in the latch circuit 41', whose base is coupled through a resistor 92 to the common line 23, turns on. Since the collector of the transistor 91 is coupled to the base of the transistor 89 through a resistor 93, turning on the transistor 91 holds the transistor 89 on, regardless of subsequent changes to the voltage at the comparator output 36. The transistor 89 in turn latches the transistor 91 on. The collector of the transistor 91 is coupled to the common line 23 through a resistor 94 and a resistor 96.

In the switch and latch circuit 43', the two transistors 89 and 91 cooperate to serve as the latch 34 in the circuit of FIG. 1. In addition, the transistor 89 serves as the switch 43 in the circuit of FIG. 1. Closing the transistor switch 89 couples the resistor 44 to the common line 23, and this establishes the voltage divider of the resistors 44 and 41. The reference voltage input 33 then begins a gradual change to a lower magnitude as the capacitor 46 charges. The voltage at the reference input 33 is illustrated in FIG. 3(*b*).

Figure 3:
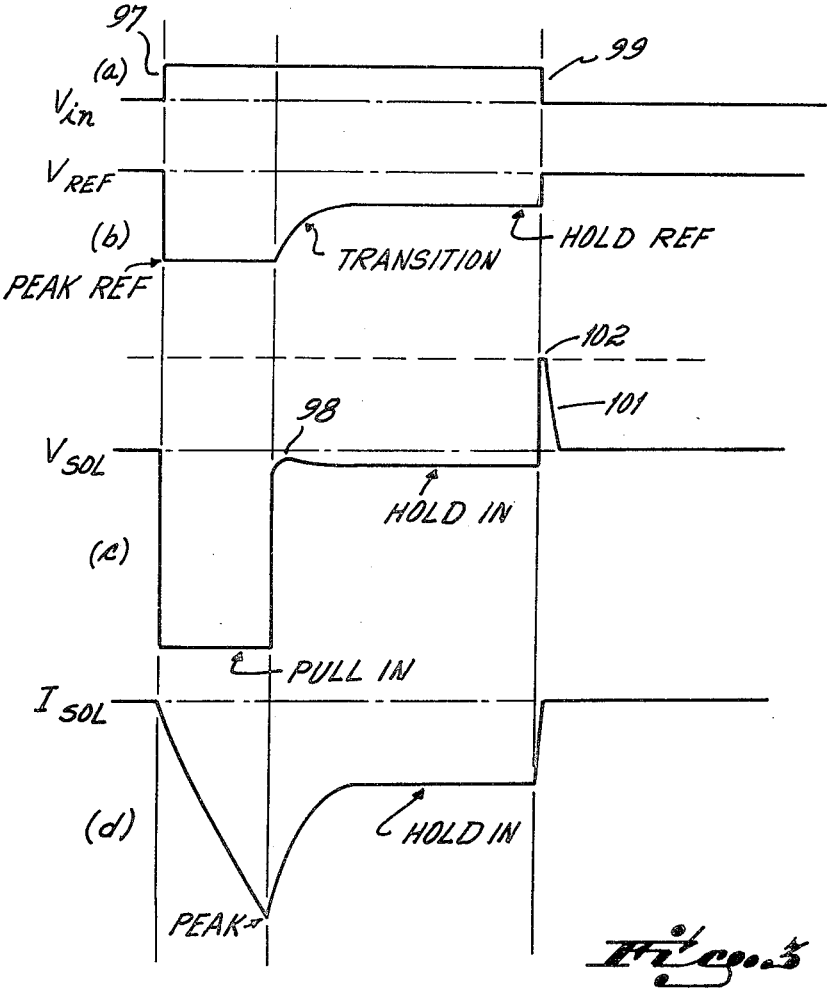
FIG. 3 is a series of waveforms taken at various points in the solenoid driver circuit of FIGS. 1 and 2.

With reference to FIG. 3, the externally applied input signal to the photodiode 58 is shown in FIG. 3(*a*). At the rising edge 97 of the input voltage, the reference voltage applied to the base of the transistor 74 goes to the peak current reference value. The externally applied input signal remains high for the duration of time that the solenoid is to be activated. The reference voltage illustrated in FIG. 3(*b*) remains at the peak current reference level until the sensed solenoid current at the input 32 reaches its preselected peak value.

When the solenoid current reaches the peak value, at the point in time indicated PEAK in FIG. 3(*d*), conduction by the transistor 74 sets the latch 43', initiating the transition of the reference voltage input 33 from the peak hold-in current reference value to a hold-in current reference signal.

Turning on the transistor 91 in the latch circuit 43' also turns on the transistor switch 42. Turning on the transistor switch 42 turns off the transistors 29 and 24, removing the pull-in voltage VP from the solenoid 21. The removal of the pull-in voltage from the solenoid results in the application of a hold-in voltage to the solenoid since the blocking diode 27 is no longer reverse biased. The current in the solenoid begins to fall as the reference signal 33 decreases in magnitude, as shall be described more fully below. The reduction in the current in the solenoid produces a short duration induced voltage 98 (FIG. 3) in opposition to the applied voltage.

Subsequent to the removal of the pull-in voltage VP from the solenoid, and the application of the hold-in voltage, the transistors 79 and 77 of the comparator and amplifier circuit 31 and the transistor 26 serve as a solenoid current control to maintain the solenoid current at the level of the hold-in current reference signal on the input line 33 to the amplifier and comparator circuit 31. The hold-in current reference signal comprises a transition signal (indicated TRANSITION in FIG. 3) as the capacitor 46 gradually charges and a steady state hold-in reference value (indicated HOLD REF in FIG. 3) after the charging of the capacitor 46 to the steady state voltage established by the voltage divider made up of the resistors 44 and 41.

If the magnitude of the sensed current input 32 to the comparator tends to become greater than the reference signal at the input 33, the transistor 74 tends to become slightly more conductive and the transistor 77 tends to become slightly less conductive. This in turn tends to turn off the transistor 79 which in turn tends to turn off the transistor 26, which reduces the current supplied to the solenoid from the hold-in voltage supply VH, returning the sensed current to the proper level. The closed loop operates in a similar fashion to increase the current to the solenoid if the sensed current signal becomes lower in magnitude than the reference signal.

Once the hold-in current reference signal at the input 33 reaches its steady state value, the comparator and amplifier circuit 31 maintains the solenoid current at this preselected hold-in current value until an externally applied turn-off signal is received by the driver circuit 10.

This turn-off signal, indicated at 99 in FIG. 3(*a*), is the falling edge of the externally applied pulse to the photodiode 58. At the trailing edge 99 of the externally applied pulse, the photodiode 58 is deenergized and the phototransistor 59 turns off. This turns on the transistors 52, 53 and 54, which couples the common line 23 to the comparator supply bus 35 and the reference bus 38, and couples the reference input 33 of the comparator to the reference bus 38. The transistors 77, 79 and 26 turn off, removing the hold-in voltage from the solenoid 21. The removal of the hold-in voltage from the solenoid induces an opposite polarity voltage pulse 101 (FIG. 3) across the solenoid as the solenoid current falls to zero. The peak of the induced voltage across the solenoid 21 is clipped, as indicated at 102 in FIG. 3(*c*), by the snubber network made up of the zener diode 47 and the diode 48.

In order to suppress noise and to prevent the accidental latching of the latch circuit 43', a capacitor 103 is connected between the common line 23 and the collector of the transistor 91, and a capacitor 104 is connected between the common line and the collector of the transistor 74. A damping network, comprising the resistor 88 at the sensed current input 32, and a resistor 106 in series with a capacitor 107 which are connected between the common line 23 and the base of the transistor 77, serves to prevent self oscillation of the hold-in current control loop. In order to further prevent oscillations, a network, comprising a resistor 108 and a capacitor 109 in series, is connected in parallel with the solenoid 21 and the current sensing resistance. A resistor 111 is connected in series between the collector of the hold-in transistor 26 and the solenoid 21. The resistor 111 prevents high frequency oscillations which can occur in certain failure modes in which the solenoid 21 is shorted to an earth ground.

In the driver circuit 10, the particular pull-in and hold-in voltages to be applied to the solenoid, as well as the peak pull-in solenoid current and the steady state hold-in current, are selected in accordance with the electrical and mechanical characteristics of the solenoid. During pull-in, it is desirable to supply a strong magnetic field quickly in order to rapidly move the valve armature into the solenoid to open the valve. If too much pull-in force is applied to the valve armature, it may reach a fully retracted position at too great a speed and "bounce". In that case, the valve armature can move back toward the valve seat, tending to close the valve.

Once a desired pull-in force is determined for a particular solenoid, setting a peak pull-in current reference in the driver circuit 10 will enable the driver to consistently apply the selected peak current to the solenoid during pull-in. This peak current establishes the peak flux and pull-in force of the solenoid.

It is also desirable to release the valve armature as quickly as possible at the end of the hold-in period. Therefore, the minimum amount of flux necessary to hold the valve armature in the solenoid during the hold-in period would normally be used. Again, dependent upon the characteristics of the solenoid, as low a hold-in current as possible is selected to minimize the flux of the magnetic field during hold-in, while still maintaining the valve armature in the solenoid.

Due to the dynamics of the solenoid and the travel and seating of the valve armature, it has been found that an abrupt transition from the peak pull-in current to the steady state hold-in current level can result in drop out of the valve armature. After the removal of the pull-in voltage, the solenoid current must usually be somewhat gradually changed from the peak value to the steady state hold-in value. The slope of the transition from the peak pull-in solenoid current to the steady state hold-in current again depends on the physical parameters of the particular solenoid. In order to provide a more gradual transition in the current, the value of the capacitor 46 in the driver circuit is increased, and in order to provide a sharper transition, the capacitor 46 is decreased.

In the description of the driver circuit 10, the pull-in supply voltage VP and the hold-in supply voltage VH have been characterized as particular voltage values. In practice, as has been discussed earlier, the voltage supplies for a driver circuit may vary. Often the supplies will vary depending upon a-c line voltage variations, which affect the levels of d-c supplies derived from the a-c line. Sometimes supply voltages vary over a period of time through aging of the voltage supply components which causes changes in component values. Since the driver circuit 10 controls the application of peak pull-in current and hold-in current to the solenoid, reasonable variations in the supply voltages, of whatever nature, do not affect the driver circuit. It should be noted that the solenoid current references at the amplifier and comparator input 33 are stable due to the use of the zener diode 71 to establish the reference supply voltage VR.

We claim:

1. A fluid dispensing control for controlling the dispensing of heated fluid, comprising:

a valve having a movable fluid control valving element for controlling the flow of fluid therethrough in dependence upon the position of said valving element;

a solenoid having an electrical coil and a movable armature connected to said valving element for selectively positioning said valve element to control the flow of fluid through said valve, said coil being in heat transfer relationship to heated fluid flowing through said valve; and a solenoid driver circuit including, means for sensing the level of current flowing through said solenoid and providing an output signal correlated thereto, power supply means, means for generating first and second reference signals correlated to predetermined peak and hold-in currents in said solenoid, respectively, means for comparing:

(i) said first reference signal and said sensing means output signal and generating in response thereto a solenoid peak current control signal when said solenoid current reaches said peak current, and (ii) said second reference signal and said sensing means output signal and generating in response thereto a solenoid hold-in current control signal correlated to the difference therebetween, solenoid current regulating means interconnecting said power supply means and said solenoid, said regulating means being sequentially responsive to, (i) an externally applied turn-on control signal, (ii) said peak current control signal, (iii) said hold-in current control signal, and (iv) an externally applied turn-off control signal, for initially energizing said solenoid to raise the current level therein until said peak solenoid current is reached, whereupon said solenoid current is reduced and maintained at a hold-in current level until said externally generated turn-off control signal is applied;

the comparing means and the solenoid current regulating means including:

(i) a comparator and amplifier circuit having a first input coupled to the current sensing means output and a second input, which is coupled to the first reference signal before the peak solenoid current is reached and which is coupled to the second reference signal after the peak solenoid current is reached;

(ii) means for coupling a first voltage across the solenoid in response to the externally applied turn-on control signal and for removing the first voltage from the solenoid in response to said solenoid peak current control signal; and (iii) means for controlling the level of a second voltage coupled across the solenoid, after the removal of the first voltage, in response to said solenoid hold-in current control signal, the comparator and amplifier circuit having a first output coupled to the first voltage coupling means and a second output coupled to the second voltage controlling means, the comparator and amplifier circuit being operable to compare its inputs to produce at its first output, when the first voltage is coupled across the solenoid, the solenoid peak current control signal, and to produce at its second output, when the controlled level of the second voltage is coupled across the solenoid, the solenoid hold-in current control signal; and a latch circuit, which has an input coupled to the first output of the comparator and amplifier circuit to receive the solenoid peak current control signal therefrom, and which has an output coupled to the first voltage coupling means for coupling said solenoid peak current control signal to the first voltage coupling means, whereby the first voltage coupling means removes the first voltage from the solenoid, the latch circuit being operable to maintain the first voltage coupling means in this condition until the latch circuit is reset.

2. The fluid dispensing control of claim 1 in which the latch circuit further includes a controlled switch which is responsive to the solenoid peak current control signal coupled to the input of the latch circuit to switch the reference generating means from generating the peak current reference signal to generating the hold-in current reference signal.

3. The fluid dispensing control of claim 2 in which the reference generating means produces a hold-in current reference signal which effects a gradual transition from the peak current reference value to a hold-in current reference value in response to operation of the switch in the latch circuit.

4. The fluid dispensing control of claim 3 in which the reference generating means is responsive to said externally applied turn-off control signal to remove the hold-in current reference signal from the comparing means, which is responsive thereto to remove the hold-in current control signal from the second voltage controlling means to effect the removal of the controlled level of the second voltage from the solenoid.

5. The fluid dispensing control of claim 4 which further comprises a snubber network coupled across the solenoid which includes a zener diode connected in series with an oppositely poled diode.

6. The fluid dispensing control of claim 1 which further comprises a snubber circuit coupled across the solenoid and operable to limit the amplitude of an induced reverse voltage across the solenoid each time said externally generated turn-off control signal is applied, whereby a portion of the magnetic energy stored in the solenoid, when each said turn-off control signal is applied, is dissipated in the snubber circuit.

7. In a solenoid-operated heated-fluid dispensing arrangement having a valve which is operable to dispense a heated fluid and a solenoid energizable to operate the valve, an improved driver circuit to energize the solenoid in response to externally applied turn-on and turn-off control signals, comprising:

(a) means for coupling a first voltage across the solenoid in response to an externally applied turn-on control signal and for removing the first voltage from the solenoid in response to a solenoid peak current control signal;

(b) means for sensing the current flowing in the solenoid to produce a sensed current output;

(c) means for comparing the sensed current output of the means (b) to a peak current reference value, when the first voltage is coupled across the solenoid, to produce a solenoid peak current control signal coupled to the means (a) when the sensed current reaches the peak current reference value; and (d) means for applying a second voltage to the solenoid after the removal of the first voltage;

the means (c) including a comparator circuit having a first input coupled to the peak current reference value and having a second input coupled to the sensed current output of the means (b), the comparator circuit being operable to compare the signals at the two inputs to produce a solenoid peak current control signal at an output when the input signals are equal; and latch means coupled between the output of the comparator circuit and the means (a) for coupling the solenoid peak current control signal to the means (a) until the latch means is reset after an externally applied turn-off control signal.

8. The solenoid driver circuit of claim 7 in which the turn-off control signal comprises the cessation of the externally applied turn-on control signal.

9. In a solenoid-operated heated-fluid dispensing arrangement having a valve which is operable to dispense a heated fluid and a solenoid energizable to operate the valve, an improved driver circuit to energize the solenoid in response to externally applied turn-on and turn-off control signals, comprising:

(a) means for coupling a first voltage across the solenoid in response to an externally applied turn-on control signal and for removing the first voltage from the solenoid in response to a solenoid peak current control signal;

(b) means for sensing the current flowing in the solenoid to produce a sensed current output;

(c) means for comparing the sensed current output of the means (b) to a peak current reference value, when the first voltage is coupled across the solenoid, to produce a solenoid peak current control signal coupled to the means (a) when the sensed current reaches the peak current reference value; and (d) means for controlling the current through the solenoid after the removal of the first voltage from the solenoid;

the means (d) including means for controlling the solenoid current to make a gradual transition from the level of current in the solenoid when the first voltage is removed to a lower, substantially constant, hold-in current; and the means (d) controlling the level of a second voltage applied to the solenoid after the removal of the first voltage in response to a solenoid hold-in current control signal and further comprising (e) means for comparing the sensed current output of the means (b) to a hold-in current reference signal while the second voltage is coupled to the solenoid to produce the solenoid hold-in current control signal which is coupled to the means (d), and (f) means for producing the hold-in current reference signal which comprises a resistor-capacitor parallel combination which is connected in series with a resistance, the series combination being coupled across a d-c supply at the time that the first voltage is removed form the solenoid, the hold-in current reference signal output being taken at the connection between the resistor-capacitor parallel network and the series resistance.

10. A fluid dispensing control for controlling the dispensing of heated fluid, comprising:

a valve having a movable fluid control valving element for controlling the flow of fluid therethrough in dependence upon the position of said valving element;

a solenoid having an electrical coil and a movable armature connected to said valving element for selectively positioning said valve element to control the flow of fluid through said valve, said coil being in heat transfer relationship to heated fluid flowing through said valve, and a solenoid driver circuit including (a) means for generating turn-on and turn-off control signals, (b) means for generating first and second voltages, (c) application means for applying said first voltage to the solenoid in response to said turn-on control signal, (d) means for conductively connecting said application means to said turn-on control signal generating means and to said first voltage generating means, (e) means for sensing the current flowing in said solenoid to produce a sensed current output signal, (f) terminating means for terminating the application of said first voltage to said solenoid, (g) means for conductively connecting the terminating means to the sensing means such that said terminating means removes said first voltage from said solenoid in response to said sensed current output signal reflecting that the current flowing in said solenoid has reached a first predetermined value, (h) means for applying said second voltage to said solenoid, (i) means for conductively connecting said application means of said second voltage to said terminating means such that said second voltage is not applied to said solenoid until after the termination of said first voltage, (j) means for regulating said second voltage applied to said solenoid, (k) means for conductively connecting said sensed output signal to said regulating means such that the current in said solenoid is reduced from said first predetermined value to a second predetermined value, lesser in magnitude, in a predetermined manner, (l) means for terminating the application of said second voltage to said solenoid, (m) means for conductively connecting said second voltage terminating means to said turn-off control signal generating means, such that said second voltage is removed from said solenoid in response to said turn-off control signal, (n) means for dissipating the current in said solenoid, and (o) means for conductively connecting said dissipating means to said solenoid such that said current in said solenoid is dissipated after the termination of said second voltage by the second voltage terminating means.

11. The fluid dispensing control of claim 10 wherein said regulating means comprises:

means for generating a preselected changing reference voltage;

comparison means;

means for conductively connecting said comparison means to said reference voltage generating means and said sensed current output signal from the current sensing means;

controlling means, conductively connected to said second voltage application means, for controlling the amount of said second voltage applied to said solenoid by said second voltage application means; and generating means conductively connected and interposed between said comparison means and said second voltage control means, for providing a control signal to said control means in response to said comparison means.

12. The fluid dispensing control of claim 11 wherein said comparison means further comprises means for controlling said terminating means.

13. The fluid dispensing control of claim 12 wherein said means for generating a preselected reference voltage comprises:

means for generating a third voltage;

voltage divider means conductively connected to said third voltage generating means, for dividing said voltage between a first and second resistor;

a capacitor connected in parallel with the second resistor;

means for conductively connecting said comparison means to said voltage divider, such that said comparison means receives a divided voltage; and voltage divider control means, interposed between and conductively connected to said voltage divider means and said comparison means such that said voltage divider means is turned on in response to said comparison means identifying as identical the voltage across the second resistor and the sensed current output signal of said current sensing means.

14. The solenoid driver circuit of any of claims 1, 7 or 9 in which a snubber circuit is coupled across the solenoid and in which the snubber circuit comprises a zener diode connected in series with an oppositely poled diode.

15. The solenoid driver circuit of claim 14 in which the snubber circuit is connected in parallel with the series connected solenoid and current sensing resistance.

* * * * *